US005632644A

United States Patent [19]

Lin

[11] Patent Number: 5,632,644

[45] Date of Patent: May 27, 1997

[54] DECORATIVE LIGHT BULB SOCKET

[76] Inventor: Mei L. Lin, 56, Min Sheng Street, Fengyuan, Taichung, Taiwan

[21] Appl. No.: 582,116

[22] Filed: Jan. 2, 1996

[51] Int. Cl.[6] ..... H01R 4/24

[52] U.S. Cl. ..... 439/419; 439/700; 439/746

[58] Field of Search ..... 439/404, 406, 439/417–419, 702–709, 733, 742–747, 700, 824

[56] References Cited

U.S. PATENT DOCUMENTS

| | | | |
|---|---|---|---|
| 2,321,470 | 6/1943 | Draving | 439/747 |
| 3,643,211 | 2/1972 | De Lano | 439/746 |
| 4,508,417 | 4/1985 | Bienwald | 439/746 |
| 4,529,260 | 7/1985 | Smith | 439/747 |
| 5,474,467 | 12/1995 | Chen | 439/419 |

*Primary Examiner*—David L. Pirlot

[57] ABSTRACT

A light bulb socket has a main body comprising inner threads, a longitudinal recess, a bottom plate, a through hole formed on the bottom plate, and a flange which is on top of the bottom plate surrounding the top edge of the through hole. The first conductor is inserted in the longitudinal recess. The second conductor is inserted in the through hole. Two grooves are formed in the periphery of the through hole. The second conductor has a round top, a neck, two slant fins, a transverse bar, and an end tip. A gap is defined by the round top. The second conductor is inserted in the through hole beneath the flange.

1 Claim, 6 Drawing Sheets

DECORATIVE LIGHT BULB SOCKET

BACKGROUND OF THE INVENTION

The invention relates to a light bulb socket. More particularly, the invention relates to a decorative light bulb socket which is adapted to receive a decorative light bulb on a Christmas tree.

Referring to FIGS. 1 to 4, a conventional lamp socket 10 has a longitudinal recess 11, a bottom slot 12 communicating with the longitudinal recess 11, a rectangular hole 13 communicating with the bottom slot 12, a flange 17 disposed on top of the rectangular hole 13, and a step-shaped block 14 adjacent to the hole 13. The first conductor 15 inserts in the longitudinal recess 11. The second conductor 16 inserts in the rectangular hole 13. A base covers the bottom of the socket 10. The second conductor 16 has the first and second turning points 162 and 163, a distal end 161, and a tip 164 at the other end. It is very difficult to insert the second conductor 16 in the rectangular hole 13. Referring to FIGS. 2 to 4, the generally L-shaped conductor 16 is inserted in the narrow interior of the hole 13. The end 161 may be blocked by the step-shaped block 14 (as shown in FIG. 2). The second turning point 163 may be blocked by the wall of the hole 13 (as shown in FIG. 3). It is very difficult to position the second conductor 16 in the predetermined position (as shown in FIG. 4). If the user applies strong force on the second conductor 16, it will be deformed easily. Referring to FIG. 5, another lamp socket 20 receives a conductor 21. The conductor 21 has a rounded head 211 and a taper-pointed end 212. The conductor 21 is not easily positioned on the predetermined position before the bulb is inserted.

SUMMARY OF THE INVENTION

An object of the invention is to provide a light bulb socket which can position the conductors steadily.

Another object of the invention is to provide a light bulb socket which can be assembled easily.

DETAILED DESCRIPTION OF THE INVENTION

Figure 1:
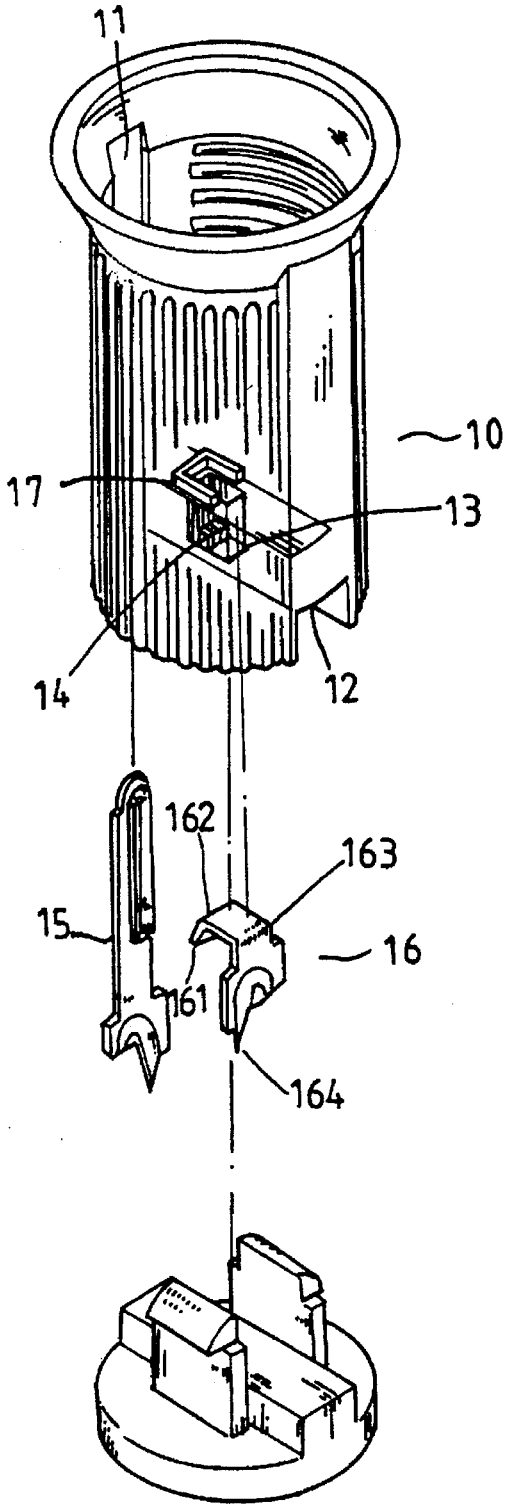
FIG.1 PRIOR ART
FIG. 1 is a perspective exploded view of a lamp socket of the prior art.
Figure 4:
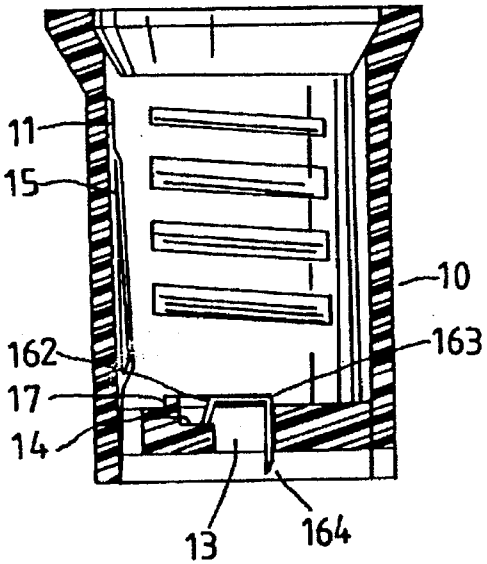
FIG.4 PRIOR ART
FIGS. 2 to 4 are the schematic view illustrating the assembly of the conductors and the lamp socket.
Figure 3:
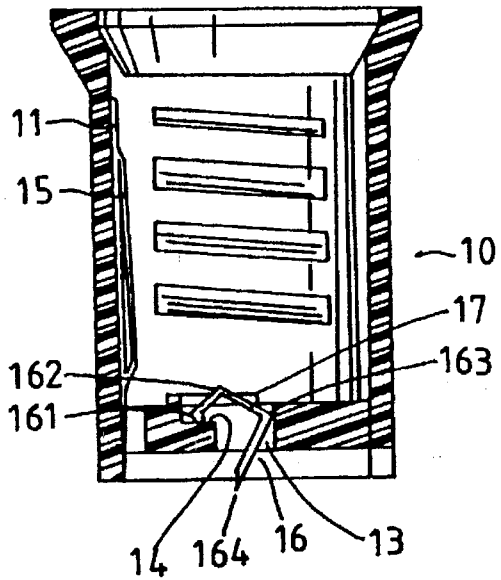
FIG.3 PRIOR ART
Figure 2:
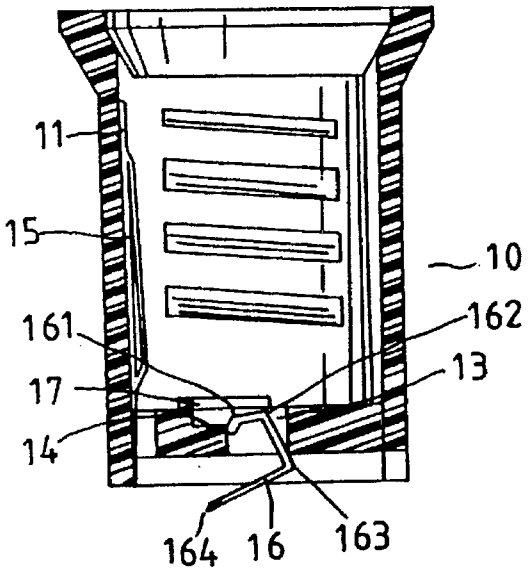
FIG.2 PRIOR ART
Figure 5:
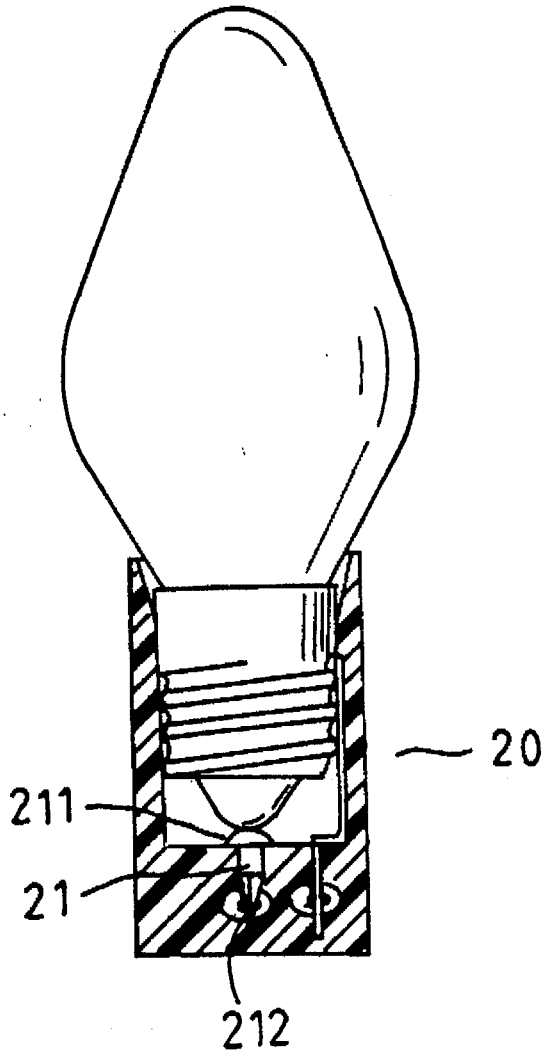
FIG.5 PRIOR ART
FIG. 5 is a perspective assembly view of another lamp socket with a lamp of the prior art.
Figure 6:
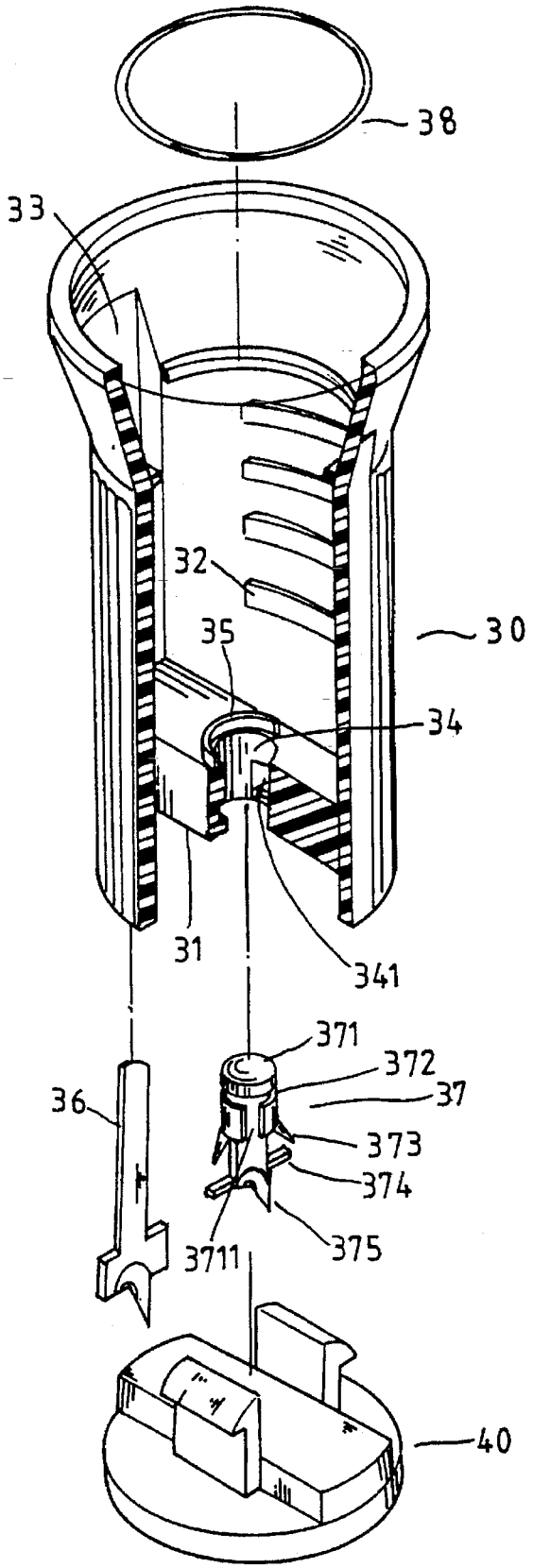
FIG. 6 is a perspective exploded view of a decorative light bulb socket of a preferred embodiment in accordance with the invention.
Figure 9:
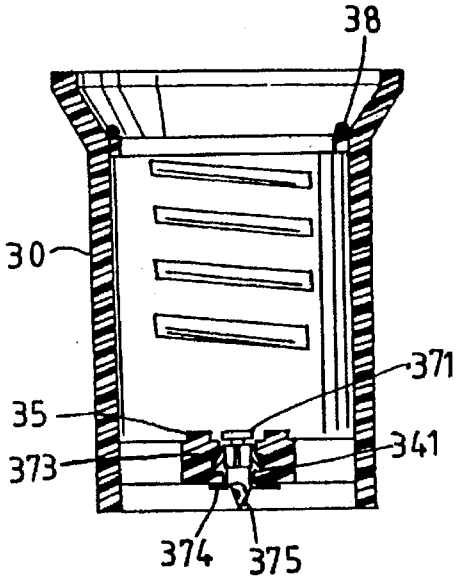
FIGS. 7 to 9 are the schematic view illustrating the assembly of the conductors and the decorative light bulb socket.
Figure 8:
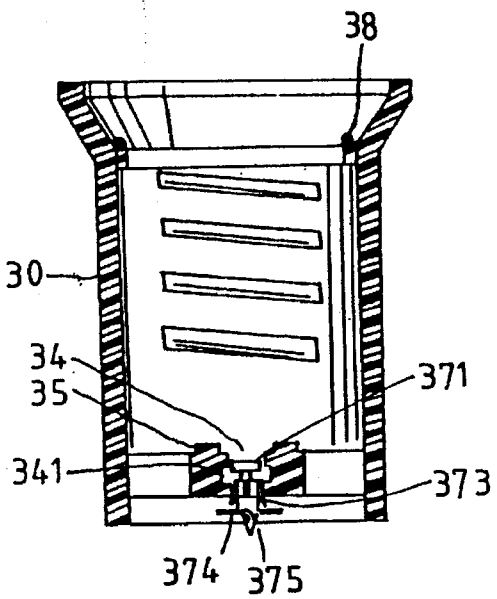
Figure 7:
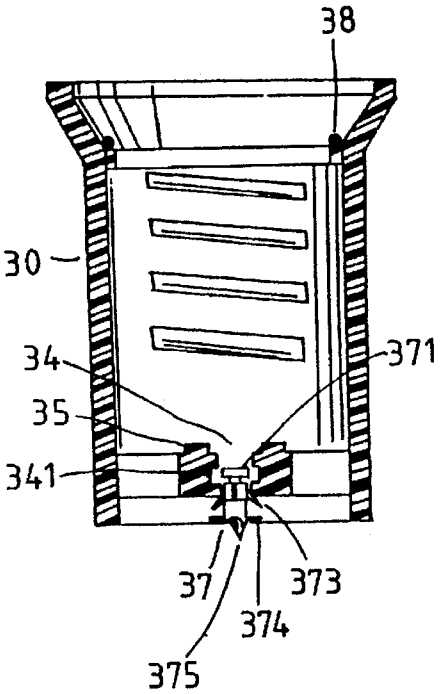
Figure 10:
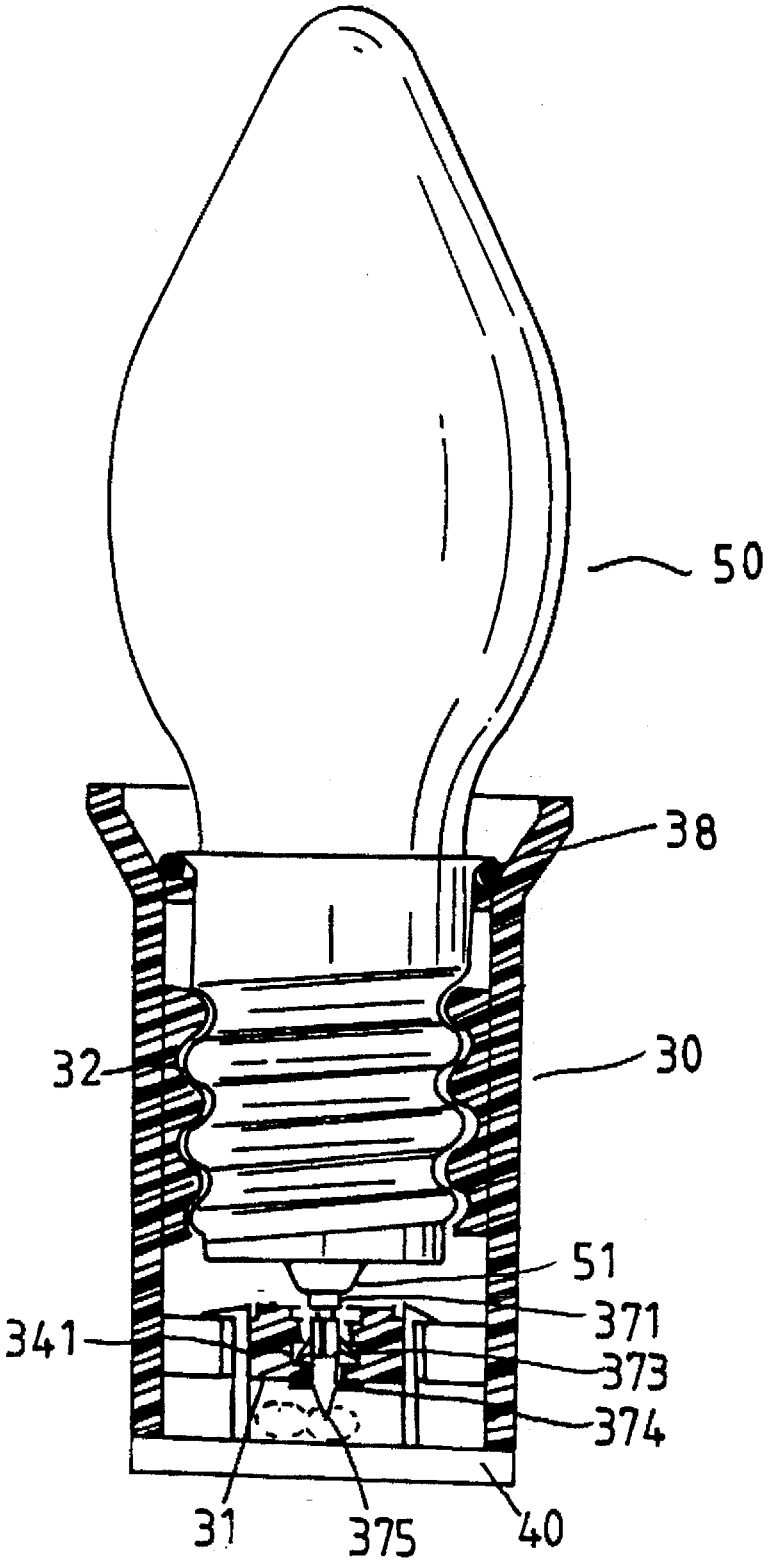
FIG. 10 is a perspective assembly view of the decorative light bulb socket with a light bulb thereon.

Referring to FIG. 6, a decorative light bulb socket has a main body 30 comprising a large number of inner threads 32, a longitudinal recess 33, a bottom plate 31, a through hole 34 formed on the bottom plate 31, and a flange which is disposed on top of the bottom plate 31 surrounding the top edge of the through hole 34. Referring to FIG. 10, the bulb 50 is screwed into the socket along the threads 32. The first conductor 36 is inserted in the longitudinal recess 33. The second conductor 37 is inserted in the through hole 34. Two grooves 341 are formed in the periphery of the through hole 34. The groove 341 is a recess groove. The second conductor 37 has a round top 371, a neck 372 beneath the round top 371, two slant fins 373 extending from the neck 372 outward, a transverse bar 374 disposed at the bottom of the second conductor 37, and an end tip 375 disposed at the distal end of the second conductor 37. A gap 3711 is defined by the round top 371. The second conductor 37 is inserted in the through hole 34 beneath the flange 35.

Referring to FIGS. 6 to 9, a washer 38 is inserted in the interior of the socket. The walls of the groove 341 restrain the round top 371 in the through hole 34. The slant fins 373 block the periphery of the groove 341. The transverse bar 374 is blocked by the bottom of the bottom plate 31. The bulb end 51 touches the round top 371. Thus the conductor 37 can be easily inserted in the hole 34, but it cannot be pulled out of the hole 34.

The invention is not limited to the above embodiment but various modification thereof may be made. It will be understood by those skilled in the art that various changes in form and detail may be made without departing from the scope of the invention.

I claim:

1. A decorative light bulb socket comprising:

a main body comprising a large number of inner threads, a longitudinal recess, a bottom plate, a through hole formed on said bottom plate, and a flange which is disposed on top of said bottom plate surrounding a top edge of said through hole;

a first conductor inserted in said longitudinal recess;

a second conductor inserted in said through hole;

two grooves formed in a periphery of said through hole;

said second conductor having a round top, a neck beneath said round top, two slant fins extending from said neck outward, a transverse bar disposed at a bottom of said second conductor, and an end tip disposed at a distal end of said second conductor; and wherein said round top is restrained in said grooves and said transverse bar is blocked by said bottom plate.

* * * * *